US010267274B2

(12) United States Patent
Miki

(10) Patent No.: US 10,267,274 B2
(45) Date of Patent: Apr. 23, 2019

(54) INTAKE NOISE REDUCTION DEVICE

(71) Applicant: NOK CORPORATION, Tokyo (JP)

(72) Inventor: Yohei Miki, Aso (JP)

(73) Assignee: NOK CORPORATION, Tokyo (JP)

( * ) Notice: Subject to any disclaimer, the term of this patent is extended or adjusted under 35 U.S.C. 154(b) by 0 days.

(21) Appl. No.: 15/524,622

(22) PCT Filed: Nov. 2, 2015

(86) PCT No.: PCT/JP2015/080875
§ 371 (c)(1),
(2) Date: May 4, 2017

(87) PCT Pub. No.: WO2016/076150
PCT Pub. Date: May 19, 2016

(65) Prior Publication Data

US 2017/0356407 A1 Dec. 14, 2017

(30) Foreign Application Priority Data

Nov. 14, 2014 (JP) ..... 2014-231990

(51) Int. Cl.
*F02M 35/12* (2006.01)
*F02M 35/10* (2006.01)

(52) U.S. Cl.
CPC ..... *F02M 35/1222* (2013.01); *F02M 35/10* (2013.01); *F02M 35/10301* (2013.01);
(Continued)

(58) Field of Classification Search
CPC ..... F02M 35/1222; F02M 35/1211; F02M 35/10301; F02M 35/10295; F02M 35/10262
See application file for complete search history.

(56) References Cited

U.S. PATENT DOCUMENTS 4,094,290 A * 6/1978 Dismuke ..... F02M 29/04 123/593
4,672,940 A * 6/1987 Nakayama ..... F02M 29/04 123/590

(Continued)

FOREIGN PATENT DOCUMENTS

DE 597505 C 5/1934
JP 2007-247547 A 9/2007

(Continued)

OTHER PUBLICATIONS

Extended European Search Report dated Mar. 27, 2018 (corresponding to EP15859491.1).

*Primary Examiner* — Hung Q Nguyen
*Assistant Examiner* — Brian P Monahon
(74) *Attorney, Agent, or Firm* — Harness, Dickey & Pierce, P.L.C.

(57) ABSTRACT

An intake noise reduction device that can mitigate deformation of a flow-regulating net portion made of an elastic body. The intake noise reduction device 100 is made of an elastic body that is disposed downstream of a throttle valve and includes an annular gasket portion 110 and a flow-regulating net portion 120 provided inside the gasket portion 110 integrally with the gasket portion 110, constituted by a linear portion having a mesh shape. The linear portion having the mesh shape constituting the flow-regulating net portion 120 includes first linear parts 121 that extend radially and second linear parts 122 that extend circumferentially. One of any given two parts of the first linear part 121 on a radially outer side has a width larger than or equal to that of the other part on a radially inner side, and a radially outermost part of the first linear part has a larger width than a radially innermost part.

3 Claims, 5 Drawing Sheets

(52) U.S. Cl.
CPC ... *F02M 35/1211* (2013.01); *F02M 35/10262* (2013.01); *F02M 35/10295* (2013.01)

(56) References Cited

U.S. PATENT DOCUMENTS 4,756,294 A * 7/1988 Nakayama ..... F02M 31/135 123/549
5,722,357 A * 3/1998 Choi ..... F02M 29/04 123/184.21
5,758,614 A * 6/1998 Choi ..... F02D 9/104 123/184.53
5,809,961 A * 9/1998 Morota ..... F02M 29/04 123/184.53
5,924,398 A * 7/1999 Choi ..... F02D 9/104 123/184.21
5,970,963 A * 10/1999 Nakase ..... F02M 35/1211 123/184.21
7,086,498 B2 * 8/2006 Choi ..... F01N 1/083 181/270
7,131,514 B2 * 11/2006 Choi ..... F01N 1/083 181/270
7,146,961 B1 * 12/2006 Westcott ..... F02M 29/04 123/184.53
7,506,626 B2 * 3/2009 Sasaki ..... F02M 35/1294 123/184.53
7,712,447 B2 * 5/2010 Plaxton ..... F02B 31/04 123/184.53
8,066,096 B1 * 11/2011 Francisco ..... B64D 33/02 181/214
8,141,538 B2 * 3/2012 Yang ..... F02M 29/04 123/184.21
8,322,157 B2 * 12/2012 Petersen ..... B01D 19/0042 123/41.44
8,602,012 B2 * 12/2013 Yang ..... F02M 29/06 123/306
2002/0017275 A1 * 2/2002 Alex ..... F02M 29/04 123/403
2007/0241517 A1 * 10/2007 Olson ..... F16J 15/122 277/628
2009/0038880 A1 * 2/2009 Asada ..... F02M 29/04 181/229
2011/0146612 A1 * 6/2011 Kusuda ..... F02M 35/10321 123/184.53
2014/0190765 A1 * 7/2014 Barre ..... B64C 1/40 181/284
2016/0010603 A1 * 1/2016 Yoshitsune ..... F02M 35/1211 181/229
2016/0146167 A1 * 5/2016 Inoue ..... F02M 35/1211 181/264
2017/0306904 A1 * 10/2017 Inoue ..... F02M 35/1211
2017/0356407 A1 * 12/2017 Miki ..... F02M 35/1222

FOREIGN PATENT DOCUMENTS

JP 2008-014279 A 1/2008
WO 2014-136666 A1 9/2014

* cited by examiner

INTAKE NOISE REDUCTION DEVICE

CROSS-REFERENCE TO RELATED APPLICATIONS

This application is a National Stage of International Application No. PCT/JP2015/080875, filed Nov. 2, 2015 (now WO 2016/076150A1), which claims priority to Japanese Application No. 2014-231990, filed Nov. 14, 2014. The entire disclosures of each of the above applications are incorporated herein by reference.

FIELD

The present disclosure relates to an intake noise reduction device that is disposed in an intake pipe and reduces an intake noise.

BACKGROUND

An intake pipe is provided internally with a throttle valve for controlling an intake amount. A problem arises in that an unusual noise occurs when the throttle valve is opened abruptly. In order to suppress the occurrence of such an unusual noise, there is a know technique for regulating the airflow by providing a flow-regulating net portion constituted by a linear portion having a mesh shape on the downstream side of the throttle valve. There is also a known technique for providing this flow-regulating net portion in an annular gasket that seals a gap between an end surface of one of two pipes constituting the intake pipe and an end surface of the other pipe thereof. In these techniques, the flow-regulating net portion is generally constituted by a material having high rigidity such as metal, and the gasket is constituted by an elastic body such as rubber. However, such a constitution involves significant costs, and in this respect, there is also a known intake noise reduction device in which the flow-regulating net portion is also constituted by an elastic body, and a gasket portion are provided in integrated fashion (see PTL 1).

When the flow-regulating net portion is made of an elastic material, it is prone to deform, unlike the design wherein it is made of high-rigidity material such as metal. Therefore, a flow-regulating net portion made of an elastic material should desirably be designed to hardly deform, in order to enhance the durability. One possibility is to make the linear parts that form the flow-regulating net portion thicker. With merely thicker linear parts, however, the mesh interstices will be smaller and the airflow will be hindered. With the airflow impeded, the flow amount is reduced, which may deteriorate the combustion efficiency, since a necessary amount of air may not be supplied to the engine. Therefore, simply making the linear parts thicker is not sufficient as a measure to suppress deformation of the flow-regulating net portion.

CITATION LIST

Patent Literature

[PTL 1] Japanese Patent Application Laid-open No. 2008-14279

SUMMARY

Technical Problem

An object of the present disclosure is to provide an intake noise reduction device that can mitigate deformation of a flow-regulating net portion made of an elastic body.

Solution to Problem

The present disclosure adopted the following means to solve the problem noted above.

Namely, the intake noise reduction device is an intake noise reduction device made of an elastic body that is disposed downstream of a throttle valve in an intake pipe and reduces an intake noise, the intake noise reduction device comprising: an annular gasket portion that seals a gap between an end surface of one of two pipes constituting the intake pipe and an end surface of the other pipe of the two pipes; and a flow-regulating net portion that is provided inside the gasket portion integrally with the gasket portion, constituted by a linear portion having a mesh shape, and configured to reduce the intake noise by regulating an airflow, wherein the linear portion having the mesh shape constituting the flow-regulating net portion includes first linear parts that extend radially and a second linear parts that extends circumferentially, and one of any given two parts of the first linear part on a radially outer side has a width larger than or equal to that of the other part on a radially inner side, and a radially outermost part of the first linear part has a larger width than a radially innermost part of the first linear parts.

According to the present disclosure, of the linear portion having the mesh shape, the radially extending first linear parts have a larger width in portions on the radially outer side than in portions on the radially inner side. Thus the rigidity is enhanced in the portions on the radially outer side of the first linear parts so that the deformation of the entire flow-regulating net portion can be mitigated. Since the portions on the radially outer side of the first linear parts are close to the part where they are joined to the gasket portion, they have little influence on the deformation of the flow-regulating net portion that is caused by the airflow. Therefore, increasing the width of the respective parts on the radially outer side does not exacerbate the deformation of the flow-regulating net portion that is caused by the airflow. By making the width in the portions on the radially inner side of the first linear parts smaller, the influence of the airflow can be reduced to mitigate the deformation of the entire flow-regulating net portion.

The width of the respective first linear parts should preferably be reduced stepwise from the radially outer side toward the inner side. The width of the respective first linear parts may be reduced by one step, or by two or more steps, from the radially outer side toward the inner side.

The width of the respective first linear parts may be reduced gradually from the radially outer side toward the inner side.

Advantageous Effects of the Disclosure

As described above, with the present disclosure, deformation of the flow-regulating net portion made of an elastic body can be mitigated.

DRAWINGS

DETAILED DESCRIPTION

Modes for carrying out this disclosure will be hereinafter illustratively described in detail based on specific embodiments with reference to the drawings. It should be noted that, unless otherwise particularly specified, the sizes, materials, shapes, and relative arrangement or the like of constituent components described in the embodiments are not intended to limit the scope of this disclosure.

Embodiment 1

Figure 1:
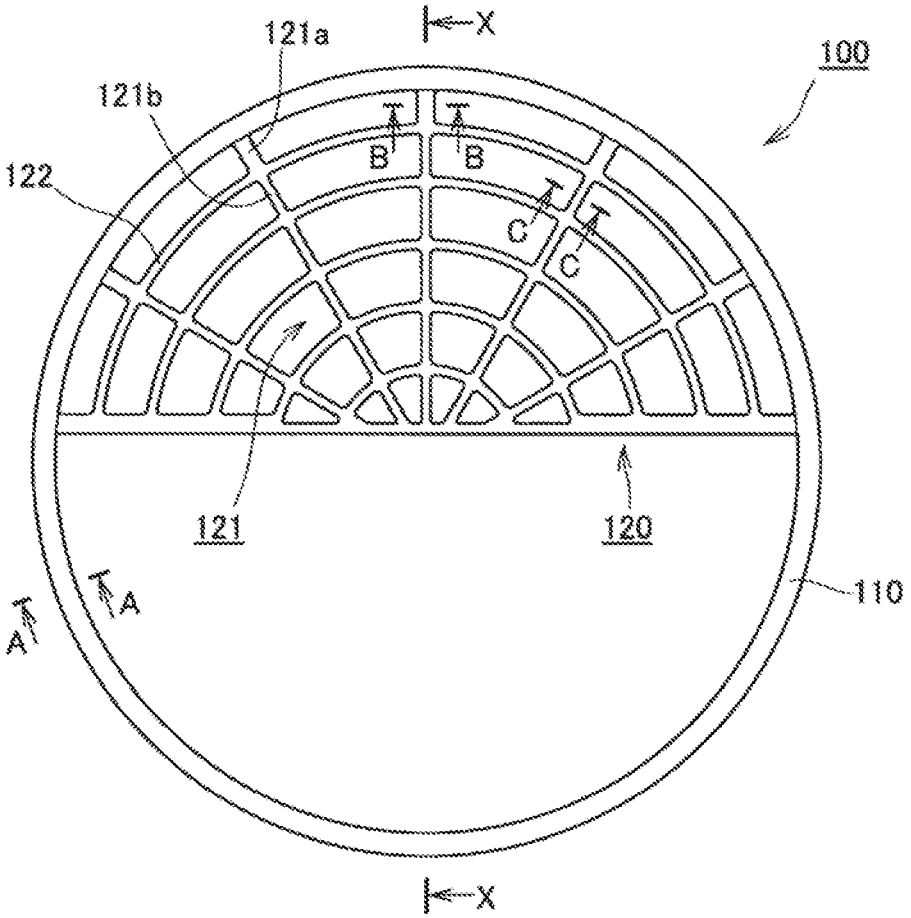
FIG. 1 is a plan view of an intake noise reduction device according to Embodiment 1 of the present disclosure.
Figure 2:
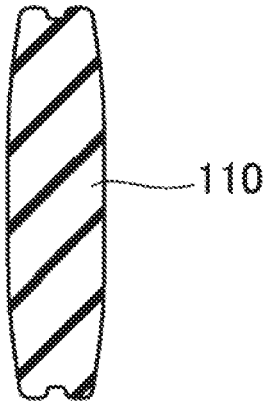
FIG. 2 is a schematic cross-sectional view of the intake noise reduction device according to Embodiment 1 of the present disclosure.
Figure 3:
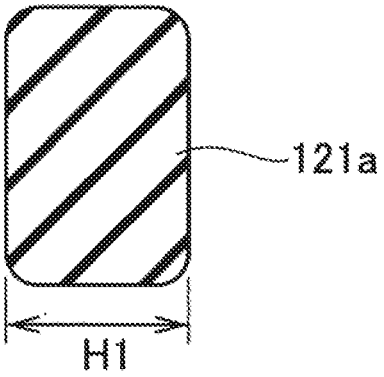
FIG. 3 is a schematic cross-sectional view of the intake noise reduction device according to Embodiment 1 of the present disclosure.
Figure 4:
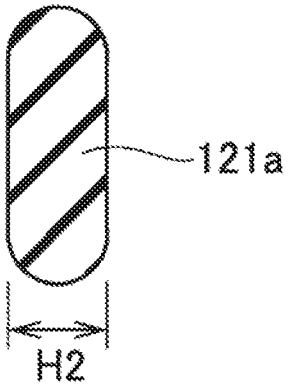
FIG. 4 is a schematic cross-sectional view of the intake noise reduction device according to Embodiment 1 of the present disclosure.
Figure 5:
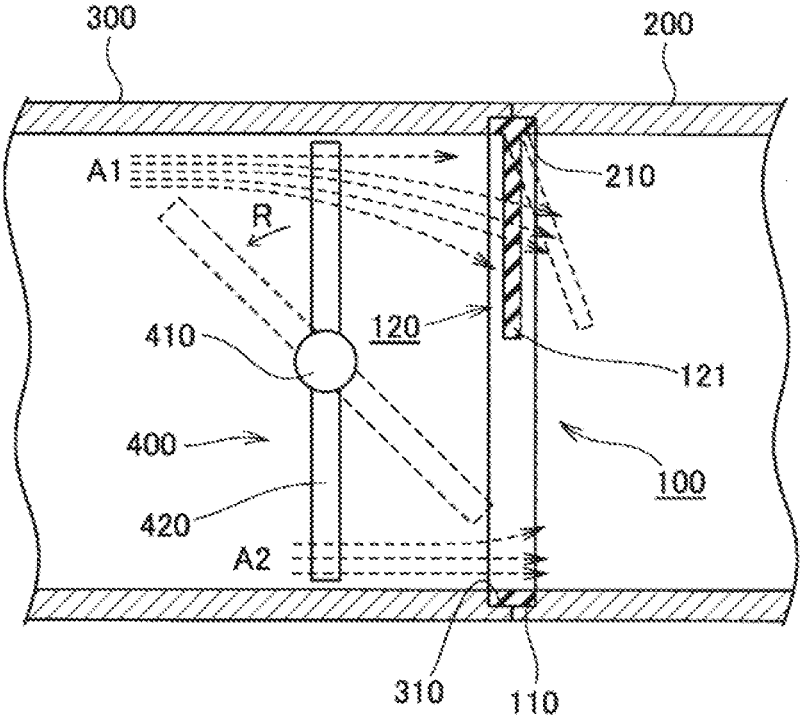
FIG. 5 is a schematic cross-sectional view of the intake noise reduction device in use according to Embodiment 1 of the present disclosure.

The intake noise reduction device according to Embodiment 1 of the present disclosure will be described with reference to FIG. 1 to FIG. 5. FIG. 1 is a plan view of the intake noise reduction device according to Embodiment 1 of the present disclosure. FIG. 2 is a schematic cross-sectional view of the intake noise reduction device according to Embodiment 1 of the present disclosure, showing a section along A-A in FIG. 1. FIG. 3 is a schematic cross-sectional view of the intake noise reduction device according to Embodiment 1 of the present disclosure, showing a section along B-B in FIG. 1. FIG. 4 is a schematic cross-sectional view of the intake noise reduction device according to Embodiment 1 of the present disclosure, showing a section along C-C in FIG. 1. FIG. 5 is a schematic cross-sectional view of the intake noise reduction device in use according to Embodiment 1 of the present disclosure. The cross section of the intake noise reduction device in FIG. 5 corresponds to the X-X cross section in FIG. 1.

<Configuration of Intake Noise Reduction Device>

The intake noise reduction device 100 according to this embodiment is made from an elastic body such as various rubber materials and plastic elastomer. This intake noise reduction device 100 is made up of an annular gasket portion 110 and a flow-regulating net portion 120. The flow-regulating net portion 120 is made integrally with the inner side (radially inner side) of the gasket portion 110. The intake noise reduction device 100 having the gasket portion 110 and flow-regulating net portion 120 in one piece can be made by a molding technique. Since molding techniques are well known, they will not be described.

The gasket portion 110 serves the function of sealing a gap between the end surfaces of one and the other of two pipes that form an intake pipe. The flow-regulating net portion 120 is formed of a linear portion having a mesh shape and serves the function of regulating the airflow, thereby to reduce the intake noise.

The intake noise reduction device 100 according to this embodiment is disposed on a downstream side of a throttle valve 400 inside the intake pipe (downstream side in a direction of airflow when the air is taken in). In this embodiment, the intake noise reduction device 100 is disposed near a joint between an intake manifold 200 (one pipe) and a throttle body 300 (the other pipe) that make up the intake pipe. The intake pipe is cylindrical and has a columnar inner circumferential surface. The throttle valve 400 is made up of a rotary shaft 410 and a disc-like valve body 420 fixed to the rotary shaft 410 and turns with the rotary shaft 410. The rotary shaft 410 of this throttle valve 400 is set to extend horizontally. This throttle valve 400 is configured to open by turning in the direction of arrow R in FIG. 5, and to close by turning in the opposite direction. With this configuration, when the throttle valve 400 starts to open, there are created airflows A1 and A2 on the upper side and lower side inside the intake pipe (see FIG. 5). These airflows A1 and A2 are not parallel to the intake pipe. The airflow A1 on the upper side travels downward from there, while the airflow A2 on the lower side travels upward from there. The throttle valve 400 keeps opening until it is horizontal. When the throttle valve 400 is fully open, the airflows substantially parallel to the intake pipe.

Since the intake pipe according to this embodiment is cylindrical as mentioned above, the gasket portion 110 is annular. This gasket portion 110 is disposed such as to fit into an annular groove, which is formed by an annular notch 210 formed along the inner circumference on an end surface of the intake manifold 200 and an annular notch 310 formed along the inner circumference on an end surface of the throttle body 300. As the gasket portion 110 is sandwiched between the end surface of the intake manifold 200 and the end surface of the throttle body 300, it exhibits the function of sealing the gap between these end surfaces.

In this embodiment, as shown in FIG. 5, the distance between the throttle valve 400 and the flow-regulating net portion 120 is shorter than the length from the rotary shaft 410 to the distal end of the valve body 420 of the throttle valve 400. Therefore, the flow-regulating net portion 120 is provided such as to occupy substantially half of the inside area of the gasket portion 110, which is circular in plan view, so that the throttle valve 400 does not collide the flow-regulating net portion 120. The rest of the area, which is substantially semicircular, is hollow. When the intake noise reduction device 100 is disposed inside the intake pipe, the semicircular area where there is the flow-regulating net portion 120 is positioned on the upper side, whereas the hollow semicircular area is positioned on the lower side.

When the throttle valve 400 opens, the lower end of the throttle valve 400 moves along the direction of the airflow, as shown in FIG. 5. Therefore, it is assumed that the airflow A2 on the lower side travels relatively smoothly and hardly any turbulence occurs. On the other hand, when the throttle valve 400 opens, the upper end of the throttle valve 400 moves against the direction of the airflow. Therefore, it is assumed that turbulence can more readily occur in the airflow A1 on the upper side. It follows that the airflow A1 on the upper side likely causes the noise, whereas the airflow A2 on the lower side does not cause the noise that much. Therefore, the intake noise can be reduced sufficiently with the configuration adopted here wherein the flow-regulating net portion 120 is provided only to the upper semicircular area of the inside area of the gasket portion 110.

<Details of Flow-Regulating Net Portion>

The flow-regulating net portion 120 will be described in more detail. The flow-regulating net portion 120 according to this embodiment is provided inside the gasket portion 110 that has a circular shape in plan view. The flow-regulating net portion 120 is made up of a plurality of linear parts radially extending outward from the center of the circle of the gasket portion 110 (hereinafter referred to as first linear part 121), and a plurality of linear parts extending circumferentially to be concentric relative to the center of the circle (hereinafter referred to as second linear part 122). These plurality of first linear parts 121 and second linear parts 122 form a mesh. In this embodiment, the angles between adjacent first linear parts 121 are set substantially equal. The radial distances between adjacent second linear parts 122 are set substantially equal. Therefore, the mesh of the flow-regulating net portion 120 is finer near the center of the circle of the gasket portion 110, and the farther from the center, the coarser.

In this embodiment, when the widths of any given two parts of the first linear part 121 are compared, one of these two parts that is on the radially outer side has a width larger than or equal to that of the other part on the radially inner side. The first linear parts 121 are designed to have a larger width in the radially outermost part than in the radially innermost part. The width of the linear part here refers to the width when viewed from the direction in which the air flows when the throttle valve 400 opens.

More specifically, the width of the respective first linear parts 121 is reduced stepwise from the radially outer side toward the inner side. In FIG. 1, one of the plurality of first linear parts 121 that extends horizontally gives the most influence on deformation of the flow-regulating net portion 120. Therefore, this horizontally extending first linear part 121 is designed to have a larger width in portions radially outer than the second radially innermost one of the plurality of second linear parts 122, as compared to portions radially inner than the second radially innermost second linear part 122. Other first linear parts 121 have a width H1 (see FIG. 3) in parts 121*a* radially outer than the outermost second linear part 122 larger than the width H2 (see FIG. 4) in parts 121*b* radially inner than that second linear part 122.

In this embodiment, the width of the respective first linear parts 121 is reduced by one step from the radially outer side toward the inner side. In the present disclosure, another design where the width of the first linear parts 121 is reduced by two or more steps from the radially outer side toward the inner side may also be adopted.

With the flow-regulating net portion 120 configured as described above, the flow of air that flows when the throttle valve 400 opens is regulated to reduce the noise. When the throttle valve 400 opens, the flow of air causes the flow-regulating net portion 120 to undergo a deformation such that the center area of the circle of the gasket portion 110 protrudes toward the downstream of the airflow as indicated by a broken line in FIG. 5.

<Advantages of the Intake Noise Reduction Device According to this Embodiment>

As described above, the intake noise reduction device 100 according to this embodiment includes the gasket portion 110 and the flow-regulating net portion 120 so that it provides not only a sealing function but also a noise reducing function. The radially extending first linear parts 121 of the linear parts that form the mesh of the flow-regulating net portion 120 according to this embodiment have a larger width in parts 121*a* on the radially outer side than in parts 121*b* on the radially inner side. Thus the rigidity is enhanced in the radially outer parts 121*a* of the first linear parts 121 so that the deformation of the entire flow-regulating net portion 120 can be mitigated. Since the radially outer parts 121*a* of the first linear parts 121 are close to the part where they are joined to the gasket portion 110, they have little influence on the deformation of the flow-regulating net portion 120 that is caused by the airflow. Therefore, increasing the width of the respective radially outer parts 121*a* does not exacerbate the deformation of the flow-regulating net portion 120 that is caused by the airflow. By making the width of the respective radially inner parts 121*b* of the first linear parts smaller, the influence of the airflow can be reduced to mitigate the deformation of the entire flow-regulating net portion 120. Thus the durability of the flow-regulating net portion 120 can be improved. Since the radially inner parts 121*b* of the first linear parts 121 have a small width, they do not block the airflow and do not cause a reduction in the flow amount.

Embodiment 2

Figure 6:
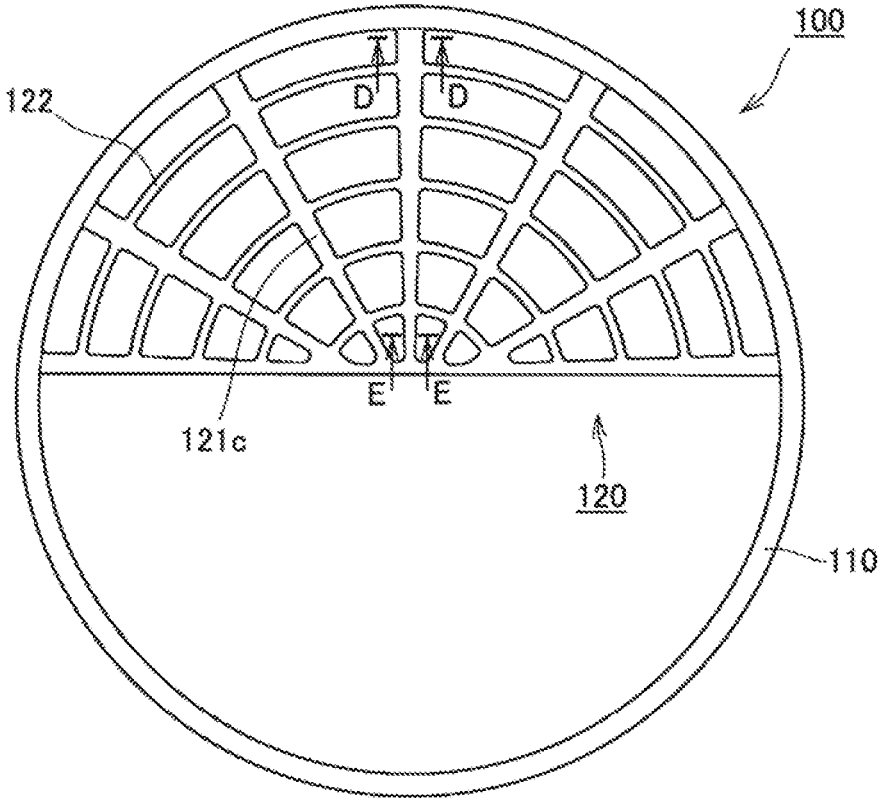
FIG. 6 is a plan view of an intake noise reduction device according to Embodiment 2 of the present disclosure.
Figure 7:
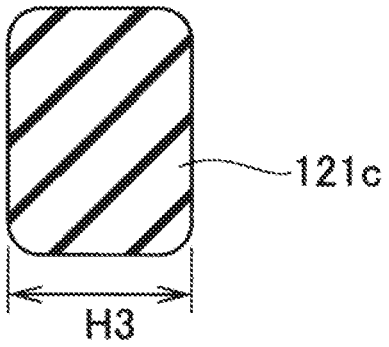
FIG. 7 is a schematic cross-sectional view of the intake noise reduction device according to Embodiment 2 of the present disclosure.
Figure 8:
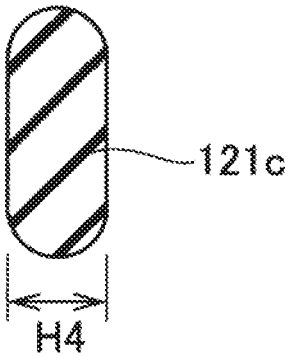
FIG. 8 is a schematic cross-sectional view of the intake noise reduction device according to Embodiment 2 of the present disclosure.

FIG. 6 to FIG. 8 show Embodiment 2 of the present disclosure. In the previously described embodiment, one design was shown wherein the width of the respective first linear parts is reduced stepwise from the radially outer side toward the inner side. In this embodiment, another design will be shown wherein the width of the respective first linear parts is reduced gradually from the radially outer side toward the inner side. Other features in the configuration and effect are the same as those of Embodiment 1, and therefore the same constituent elements are given the same reference numerals and will not be described again. FIG. 6 is a plan view of the intake noise reduction device according to Embodiment 2 of the present disclosure. FIG. 7 is a schematic cross-sectional view of the intake noise reduction device according to Embodiment 2 of the present disclosure, showing a section along D-D in FIG. 6. FIG. 8 is a schematic cross-sectional view of the intake noise reduction device according to Embodiment 2 of the present disclosure, showing a section along E-E in FIG. 6.

Similarly to Embodiment 1, the intake noise reduction device 100 according to this embodiment is made from an elastic body such as various rubber materials and plastic elastomer. This intake noise reduction device 100 is made up of an annular gasket portion 110 and a flow-regulating net portion 120. Similarly to Embodiment 1, the flow-regulating net portion 120 of this embodiment is also made up of a plurality of first linear parts 121*c* radially extending outward from the center of the circle of the gasket portion 110, and a plurality of second linear parts 122 extending circumferentially to be concentric relative to the center of the circle.

In this embodiment, when the widths of any given two parts of a first linear part 121*c* are compared, one of these two parts that is on the radially outer side has a width larger than that of the other part on the radially inner side. It goes without saying that the width in the radially outermost portions of the first linear parts 121*c* is larger than the width in the radially innermost portions thereof. The width of the linear part here refers to the width when viewed from the direction in which the air flows when the throttle valve 400 opens.

More specifically, the width of the respective first linear parts 121*c* is reduced gradually from the radially outer side toward the inner side. For example, the width H3 (see FIG. 7) of a first linear part 121*c* in the D-D cross-sectional area in FIG. 6 is larger than the width H4 (see FIG. 8) of the first linear part 121*c* in the E-E cross-sectional area.

The same effects as those of Embodiment 1 can be achieved by the intake noise reduction device 100 according to this embodiment configured as described above.

(Others)

In each of the embodiments described above, the flow-regulating net portion 120 is provided to the substantially semicircular region inside the gasket portion 110. An alternative design where the flow-regulating net portion is provided to the entire region inside the gasket portion may also be adopted. In this case, the airflow A2 on the lower side shown in FIG. 5 can also be regulated. To prevent the throttle valve 400 from contacting the flow-regulating net portion, however, the throttle valve 400 and the flow-regulating net portion need to be separated by a longer distance than the length from the rotary shaft 410 to the distal end of the valve body 420 of the throttle valve 400.

REFERENCE SIGNS LIST

100 intake noise reduction device
110 gasket portion
120 flow-regulating net portion
121 first linear parts
121*a* radially outer part
121*b* radially inner part
121*c* first linear parts
122 second linear parts
200 intake manifold
300 throttle body
400 throttle valve
410 rotary shaft
420 valve body

The invention claimed is:

1. An intake noise reduction device made of an elastic body that is disposed downstream of a throttle valve in an intake pipe and reduces an intake noise, the intake noise reduction device comprising:

an annular gasket portion that seals a gap between an end surface of one of two pipes constituting the intake pipe and an end surface of the other pipe of the two pipes; and a flow-regulating net portion that is provided inside the gasket portion integrally with the gasket portion, constituted by a linear portion having a mesh shape, and configured to reduce the intake noise by regulating an airflow, wherein the flow-regulating net portion covers only a portion of an opening extending between the two pipes while a remainder of the opening remains uncovered, wherein the linear portion having the mesh shape constituting the flow-regulating net portion includes a plurality of first linear parts that all extend radially from a common center and a plurality of second linear parts that all extend circumferentially relative to the common center and at different radial distances from the common center, and one of any given two parts of the first linear part on a radially outer side has a width larger than or equal to that of the other part on a radially inner side, and a radially outermost part of the first linear part has a larger width than a radially innermost part of the first linear parts.

2. The intake noise reduction device according to claim 1, wherein the width of the respective first linear parts is reduced stepwise from the radially outer side toward the inner side.

3. The intake noise reduction device according to claim 1, wherein the width of the respective first linear parts is reduced gradually from the radially outer side toward the inner side.

* * * * *